US009743190B2

(12) United States Patent
Fehervari et al.

(10) Patent No.: US 9,743,190 B2
(45) Date of Patent: Aug. 22, 2017

(54) ACOUSTIC DIAPHRAGM

(71) Applicant: Bose Corporation, Framingham, MA (US)

(72) Inventors: Agota F. Fehervari, Lexington, MA (US); George Nichols, Dover, MA (US)

(73) Assignee: Bose Corporation, Framingham, MA (US)

( * ) Notice: Subject to any disclaimer, the term of this patent is extended or adjusted under 35 U.S.C. 154(b) by 78 days.

(21) Appl. No.: 14/675,120

(22) Filed: Mar. 31, 2015

(65) Prior Publication Data

US 2016/0295331 A1 Oct. 6, 2016

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/12*** | (2006.01) |
| *H04R 1/06* | (2006.01) |
| *H04R 31/00* | (2006.01) |

(52) U.S. Cl.

CPC ..... *H04R 7/125* (2013.01); *H04R 1/06* (2013.01); *H04R 31/003* (2013.01); *H04R 2207/021* (2013.01); *H04R 2307/021* (2013.01); *H04R 2307/023* (2013.01); *H04R 2307/025* (2013.01); *H04R 2307/029* (2013.01)

(58) Field of Classification Search

CPC ..... H04R 7/125; H04R 2207/021; H04R 2307/021; H04R 2307/029; H04R 2307/025; H04R 2307/023

USPC ..... 381/428

See application file for complete search history.

(56) References Cited

U.S. PATENT DOCUMENTS

| | | | | |
|---|---|---|---|---|
| 3,588,552 | A | 6/1971 | Schafft | |
| 3,616,529 | A | 11/1971 | Iding | |
| 4,395,597 | A | 7/1983 | Suzuki et al. | |
| 5,274,199 | A | 12/1993 | Uryu et al. | |
| 6,723,761 | B1 | 4/2004 | Thomas et al. | |
| 7,913,808 | B2 | 3/2011 | Fehervari et al. | |
| 8,172,035 | B2 | 5/2012 | Fehervari et al. | |
| 2002/0094108 | A1* | 7/2002 | Yanagawa | H04R 7/08 381/423 |
| 2004/0129492 | A1 | 7/2004 | Bertagni et al. | |
| 2005/0211499 | A1 | 9/2005 | Schwarzenberg et al. | |
| 2006/0062423 | A1 | 3/2006 | Kawata et al. | |

(Continued)

FOREIGN PATENT DOCUMENTS

| | | |
|---|---|---|
| DE | 10303244 B3 | 8/2004 |
| EP | 0087177 A1 | 8/1983 |

(Continued)

OTHER PUBLICATIONS

The International Search Report and the Written Opinion of the International Searching Authority mailed on Aug. 8, 2016 in PCT Application No. PCT/US2016/024801.

*Primary Examiner* — Duc Nguyen
*Assistant Examiner* — Sean H Nguyen
(74) *Attorney, Agent, or Firm* — Brian M. Dingman; Dingman IP Law, PC

(57) ABSTRACT

An acoustic diaphragm made at least in part from an expanded material. The expanded material includes one or more of cellulose, synthetic fibers and glass fibers. The expanded material has more than about 55% by volume voids.

17 Claims, 16 Drawing Sheets

(56) References Cited

U.S. PATENT DOCUMENTS

| | | | | |
|---|---|---|---|---|
| 2008/0021134 | A1* | 1/2008 | Yoshida | B30B 15/061 523/219 |
| 2009/0016563 | A1* | 1/2009 | Wei | H04R 9/02 381/430 |
| 2010/0046788 | A1* | 2/2010 | Harris | H04R 9/043 381/404 |
| 2010/0206659 | A1* | 8/2010 | Funahashi | H04R 31/003 181/169 |
| 2015/0256938 | A1* | 9/2015 | Rousseau | H04R 7/122 381/152 |

FOREIGN PATENT DOCUMENTS

| | | | |
|---|---|---|---|
| JP | 3456819 | B2 | 2/1996 |
| JP | 2002069898 | A | 3/2002 |
| JP | 2003049400 | A | 2/2003 |
| JP | 2004091976 | A | 3/2004 |
| JP | 2004339649 | A | 12/2004 |
| JP | 2005336657 | A | 12/2005 |
| JP | 2006033648 | A | 2/2006 |
| JP | 3875501 | B2 | 1/2007 |
| JP | 2008031601 | A | 2/2008 |
| JP | 2008223194 | A | 9/2008 |
| JP | 4268980 | B2 | 5/2009 |
| JP | 4268995 | B1 | 5/2009 |
| JP | 4343979 | B2 | 10/2009 |
| JP | 4347709 | B2 | 10/2009 |
| JP | 4707043 | B2 | 6/2011 |
| JP | 4772031 | B2 | 9/2011 |
| JP | 5133587 | B2 | 1/2013 |
| JP | 5249820 | B2 | 7/2013 |
| JP | 2014070319 | A | 4/2014 |

* cited by examiner

ACOUSTIC DIAPHRAGM

BACKGROUND

This disclosure relates to an acoustic diaphragm.

Acoustic transducers include a diaphragm that is used to reproduce sound. An ideal diaphragm would be rigid to prevent uncontrolled motions, and would have low mass to minimize starting force requirements and energy storage issues.

SUMMARY

All examples and features mentioned below can be combined in any technically possible way.

In one aspect, an acoustic diaphragm includes an expanded paper material with a cellulose-containing layer having more than about 55% by volume voids. In another aspect, an acoustic diaphragm includes an expanded felt material layer comprising synthetic and glass fibers and having more than about 55% by volume voids. In another aspect an acoustic diaphragm comprises an expanded material comprising one or more of: cellulose, synthetic fibers and glass fibers, wherein the expanded material has more than about 55% by volume voids.

Embodiments may include one of the following features, or any combination thereof. The expanded material may have more than about 70% by volume voids, and more specifically may have at least about 97% by volume voids. The expanded material may have a density of from at least about 0.04 g/cc to about 0.7 g/cc. The expanded material may have a density, and the density may vary by location in the diaphragm. For example, the diaphragm may have a generally round shape, and the density may vary by radial location. The expanded material may have an aerial density of from about 0.4 to about 1 kg/m$^3$. The expanded material may have a thickness of from about 0.2 mm to about 10 or 11 mm.

Embodiments may include one of the following features, or any combination thereof. The expanded material may comprise, or may consist of, or may consist essentially of, cellulose and a polymer material. The polymer material may be an acrylic. The acrylic may comprise polyacrylonitrile.

Embodiments may include one of the following features, or any combination thereof. The acoustic diaphragm may further comprise a skin at least partially overlying and fixed to the expanded material, wherein the skin is made from a different material than that of the expanded material. The skin may comprise at least one of a metal layer (e.g., aluminum), a plastic layer, and a thermoset layer. The acoustic diaphragm may further comprise an adhesive material between the skin and the expanded material. The adhesive material may comprise at least one of: a polymer, a thermoset such as epoxy, a low-density polyethylene, a pressure-sensitive adhesive, a carboxylated ethylene/vinyl acetate (EVA) copolymer, a thermoplastic elastomer (TPE), and a styrene-isobutylene-styrene block copolymer. The skin may have a thickness of from about 7 microns to about 250 microns. The material of the acoustic diaphragm of low areal density may have a longitudinal speed of sound of from about 1,500 m/s to about 7,000 m/s. The acoustic diaphragm may further include a damping material on a surface of or impregnated into the expanded material. The expanded material may further comprise one or more of synthetic fibers and glass fibers.

Embodiments may include one of the following features, or any combination thereof. The acoustic diaphragm may further comprise skins at least partially overlying and fixed to both surfaces of the expanded material, wherein the skins are made from a different material than that of the expanded material. The acoustic diaphragm may have opposed surfaces, wherein at least one surface has ribbing. The ribbing may be radial. The acoustic diaphragm may have a generally annular shape. The radial ribbing may extend along at least most of the length of radii of the annulus. The acoustic diaphragm may have a generally frustoconical shape. The acoustic diaphragm may be generally flat. The acoustic diaphragm may have a bending resistance, defined as $|E^*|*h^3$, where E* is the complex tensile modulus and h is the thickness of the diaphragm. For diaphragms of equal mass the bending resistance is proportional to the material merit number of $|E^*|/\rho^3$, where ρ is density. For diaphragms (preferably for those with areal density between about 0.1 and about 1 kg/m$^2$), $|E^*|/\rho^3$ may range from about 30 to about 500 Pa*m$^9$/kg$^3$.

In another aspect, an acoustic diaphragm includes a paper layer having opposed surfaces and a skin at least partially overlying and fixed to at least part of at least one surface of the paper layer, wherein the skin is made from a different material than the paper layer.

Embodiments may include one of the following features, or any combination thereof. The paper layer may comprise an expanded paper material. The expanded paper material may have between about 55% and about 97% by volume voids. The paper layer may have a density of from about 0.04 g/cc to about 0.7 g/cc. The paper layer may have a thickness of from about 0.2 mm to about 10 or 11 mm.

Embodiments may include one of the following features, or any combination thereof. The skin may comprise at least one of: a metal layer (e.g., aluminum), a plastic layer, and a thermoset layer (e.g., cured polyurethane). The acoustic diaphragm may further comprise an adhesive material between the skin and the paper layer. The adhesive material may comprise at least one of: a polymer, a thermoset such as epoxy, a low-density polyethylene, a pressure-sensitive adhesive, a carboxylated ethylene/vinyl acetate (EVA) copolymer, a thermoplastic elastomer (TPE), and a styrene-isobutylene-styrene block copolymer. The skin may have a thickness of from about 7 microns to about 250 microns. The acoustic diaphragm may further comprise skins at least partially overlying and fixed to both surfaces of the paper layer, wherein the skins are made from a different material than the paper layer. The acoustic diaphragm may further include a damping material on a surface of or impregnated into expanded material layer. The paper layer may further comprise one or more of synthetic fibers and glass fibers. The paper layer may comprise an expanded paper material, which may have between about 55% and about 97% voids.

In another aspect, the disclosure includes expanded paper consisting essentially of cellulose and polymer, where the expanded paper has more than about 55% by volume voids and preferably has at least about 70% voids, and more preferably about 97% voids.

In another aspect, a method of manufacturing expanded material includes creating a suspension consisting essentially of cellulose fibers (for expanded paper diaphragms) or plastic and glass fibers (for synthetic expanded diaphragms). There are particles of a physical blowing agent, and a liquid suspension medium. Each particle of blowing agent comprises a volatile substance encapsulated in a polymer shell. The suspension is felted for molding under conditions such that the resulting expanded material has more than about 55% by volume voids.

In another aspect an acoustic diaphragm assembly includes a diaphragm comprising a cellulose-containing material and having opposed surfaces, and a voice coil electrical lead that is at least partially embedded in the diaphragm.

Embodiments may include one of the following features, or any combination thereof. The diaphragm may comprise a plurality of layers, and at least two of the layers may be coupled together, for example with an adhesive material that may also be a damping material. The electrical lead may be coated at least in part with the adhesive material. A portion of the electrical lead may be located between the two layers that are coupled together. In one example, the layers comprise a cellulose-containing layer and a skin at least partially overlying and fixed by an adhesive to the cellulose-containing layer, wherein the skin is made from a different material than the cellulose-containing layer, and wherein a portion of the electrical lead is located between the cellulose-containing layer and the skin. The cellulose-containing layer may comprise expanded cellulose-containing paper material that has more than about 55% by volume voids.

Embodiments may include one of the following features, or any combination thereof. The skin may comprise at least one of: a metal layer, a plastic layer, and a thermoset layer. The adhesive material may comprise a damping material. A skin may have a thickness of from about 7 microns to about 250 microns. The cellulose-containing layer may have a density between about 0.04 g/cc and about 0.7 g/cc.

Embodiments may include one of the following features, or any combination thereof. A portion of the electrical lead may not be embedded in the diaphragm, and that portion may be crimped. The diaphragm may comprise at least one of: an expanded cellulose-containing paper material and an expanded synthetic paper material.

In another aspect, an acoustic diaphragm assembly includes a diaphragm comprising at least one of: an expanded cellulose-containing paper material and an expanded synthetic paper material, and one or more skins at least partially overlying and fixed to the expanded material by an adhesive material, wherein a skin is made from a different material than the expanded material. There is a voice coil electrical lead that is at least partially disposed within the diaphragm between the expanded material and the skin.

Embodiments may include one of the following features, or any combination thereof. The skin may comprise at least one of: a metal layer, a plastic layer, and a thermoset layer. The skin may have a thickness of from about 7 microns to about 250 microns. The expanded material may have more than about 70% by volume voids and a density between about 0.04 g/cc and about 0.7 g/cc. The expanded paper material may comprise synthetic fibers and glass fibers.

In another aspect, an acoustic diaphragm assembly includes a diaphragm comprising an expanded paper material, wherein the expanded paper material has more than about 70% by volume voids, and a density between about 0.04 g/cc and about 0.7 g/cc, and a voice coil electrical lead that is at least partially disposed within the expanded paper material.

Embodiments may include one of the following features, or any combination thereof. The expanded paper material may comprise at least one of: expanded cellulose-containing paper material and expanded synthetic paper material. The diaphragm may comprise a plurality of layers, and at least two of the layers may be coupled together with a damping material. The layers may comprise a cellulose-containing layer and a skin at least partially overlying and fixed by an adhesive to the cellulose-containing layer, wherein the skin is made from a different material than the cellulose-containing layer, and wherein a portion of the electrical lead is located between the cellulose-containing layer and the skin. A portion of the electrical lead may be located between the two layers that are coupled together. The expanded paper material may comprise synthetic fibers and glass fibers.

DETAILED DESCRIPTION

Highly expanded, low density, cellulose (e.g., paper)-based and synthetic fiber-based foams are light and stiff, and thus are well suited for use in acoustic diaphragms. Their stiffness can be enhanced with thin coatings (skins) of stiff materials on some or all of one or both faces of the diaphragm. Damping can be enhanced by the use of highly damped materials between the foam and the skin, or by integrating (e.g., impregnating) the damping materials into the foam. The foam diaphragms can be produced in various shapes, including flat diaphragms and shallow cones. Further, the foams can be created with variable thickness, to produce acoustic transducers with tailored performance.

Figure 1:
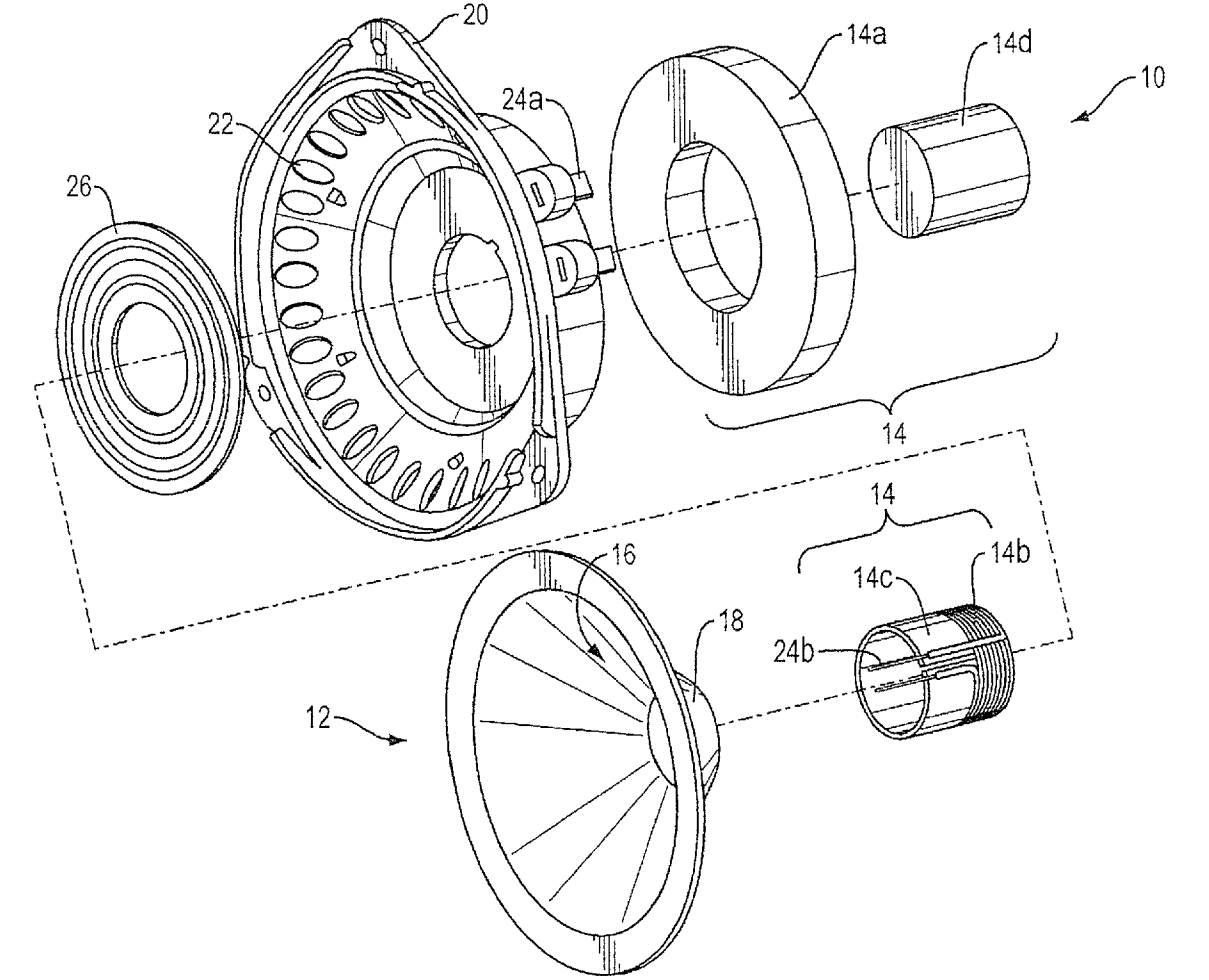
FIG. 1 is simplified schematic view of an acoustic transducer.

A loudspeaker 10, shown in FIG. 1, includes an acoustic diaphragm 12 made as described herein. Diaphragm 12 has an inside 16 and an outside 18. The relationship of the motor 14 (including a magnet 14*a*, voice coil 14*b*, bobbin 14*c*, and pole 14*d* in the example of FIG. 1) is for illustration only. Other arrangements are possible, for example, the motor 14 may be located inside the volume defined by the diaphragm. Other components of the loudspeaker in the example of FIG. 1 include a basket 20 with ventilation holes 22, electrical connections 24*a* and 24*b*, and a suspension 26. Other configurations are possible, for example, the loudspeaker may have multiple suspension elements (e.g., a spider and a surround) or a single suspension element (a spider or a surround). The diaphragm as described herein could be used in any variety of acoustic transducer configurations, and those shown herein are for illustration only.

Figure 2A:
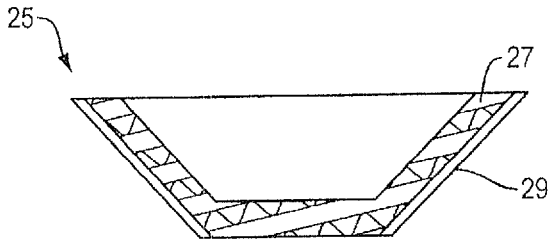
FIG. 2A is a cross-sectional view of an acoustic diaphragm.
Figure 2B:
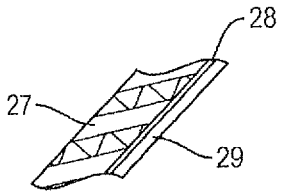
FIG. 2B is a partial enlarged view of the acoustic diaphragm of FIG. 2A.

Acoustic diaphragm 25, FIGS. 2A and 2B, comprises in some examples herein expanded cellulose-containing paper material or expanded synthetic paper material. The expanded material makes up part or all of layer 27. The expanded material has more than about 55% by volume voids. The expanded material may preferably have more than about 70% voids, and may more preferably have at least about 97% voids. The range of voids may be between about 55 and about 97.5% by volume. The ranges of voids may be calculated based on the density of the expanded composite material and the density of cellulose. The density of residual acrylics from the blowing agent is about 1.17 g/cc. This would change the upper limit to about 97% if 40% blowing agent was used in the material, of which about 90% remained as residual acrylics. The density of the expanded material is preferably between about 0.04 g/cc and 0.7 g/cc. The density may vary by location in the layer 27. For example, when the diaphragm is generally round in shape, the density may vary by radial location. Density variation across a diaphragm is further described below. The thickness of layer 27 is preferably from about 0.2 mm to about 10 or 11 mm. These variables are further described and illustrated elsewhere herein.

Figure 11A:
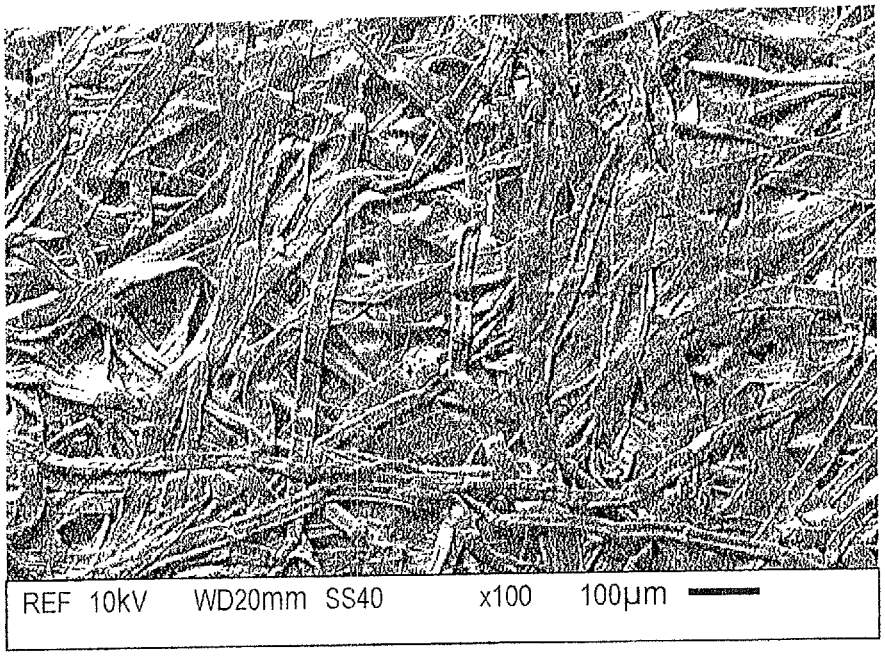
FIG. 11A (PRIOR ART)
FIGS. 11A and 11B are enlarged images of a prior-art traditional paper and an expanded paper according to this disclosure, respectively.
Figure 11B:
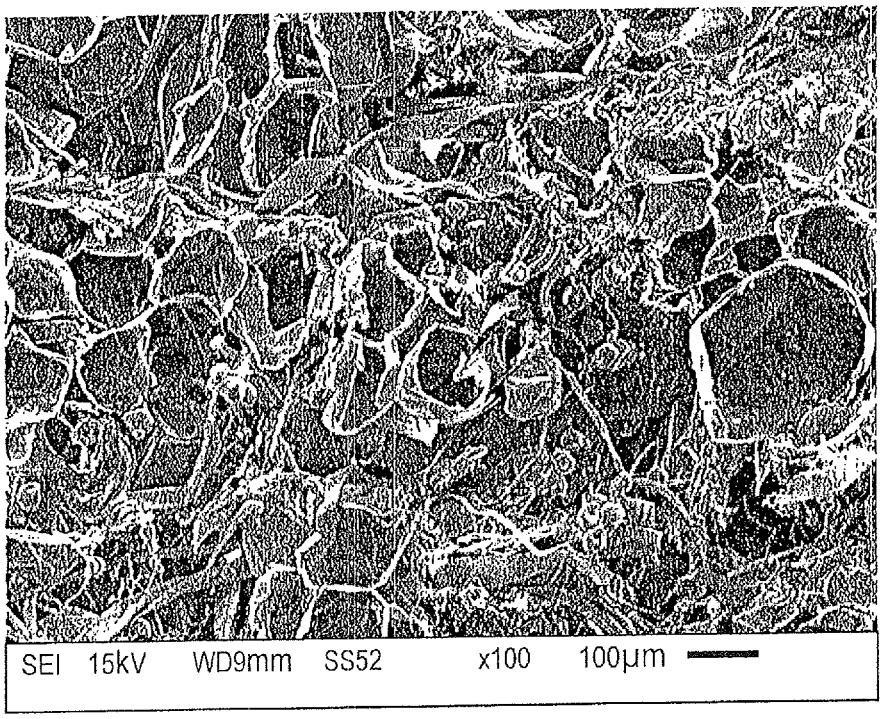

The expanded cellulose-containing paper material may also include a polymer material such as an acrylic, though other polymers may be used. Polyacrylonitrile is one preferred acrylic material, though others may be used. The expanded paper material may be fabricated by mixing cellulose fibers, particles of a physical blowing agent such as described herein, and a liquid suspension medium such as water, to form a suspension, and then felting the suspension and molding the felted suspension under conditions that cause the blowing agent to form voids, resulting in an expanded paper material that has more than about 55% by volume voids. An example of a prior art normal (i.e., not expanded) paper, and an expanded paper made in the described fashion, are shown in FIGS. 11A and 11B, respectively. The expanded paper preferably has more than about 70% voids, and more preferably has up to about 97%-98% voids. These voids may be created by the use of a physical blowing agent during the expanded paper molding operation, as described elsewhere herein.

To fabricate an expanded paper diaphragm, cellulose, synthetic, and/or glass fibers may first be mixed with a liquid suspension medium, such as water. A physical blowing agent (such as those described herein) having a liquid material encapsulated in polymer shells, may be added to the mixture. The mixture is then deposited onto a die or tool placed on top of a screen using a felting tube. The die or tool may have the desired shape of the diaphragm to be formed. For example, the die or tool may have grooves or indentations, and may be a generally flat or generally conical shape (though other shapes may be used). Following deposition of the mixture onto the die or tool, a vacuum is applied to the mixture from the bottom of the felting machine through the screen. The vacuum pulls the mixture onto the die and removes most of the water from the mixture, leaving only a wet felt comprising cellulose, synthetic and/or glass fibers and the blowing agent, if used, on the die. If the die contains grooves or indentations, the vacuum pulls the mixture into those grooves or indentations, thus forming a diaphragm having variable areal density. Next, the wet material is inserted into a press, and heat and/or pressure are applied to mold the diaphragm. While in the press, the water steam evaporates and the material dries. If a blowing agent is used, the blowing agent expands, thus forming the expanded paper material.

The expanded synthetic paper material does not contain cellulose. It typically includes synthetic fibers and glass, and potentially other components. An unexpanded synthetic paper material that includes components used in the present synthetic paper expanded material is disclosed in U.S. Pat. No. 8,172,035, the disclosure of which is incorporated herein by reference in its entirety.

The polymer material may be present in the cellulose-containing expanded paper material from the residual shells of the blowing agent. In one example the blowing agent comprises a liquid (such as pentane and other low boiling hydrocarbons) that gasifies and greatly expands under the molding conditions (i.e., with application of pressure and temperature), where that liquid material is carried in polymer capsules or shells. The polymer may be an acrylonitrile homopolymer or copolymer. Other polymers may be used for the blowing agent shell. Once the molding operation is complete, the polyacrylonitrile (or other polymer from the blowing agent shell) remains in the expanded paper. In this example, then, the expanded paper consists essentially of only (or consists only of) cellulose and the polyacrylonitrile (or other residual polymer from the blowing agent capsules). In other examples the expanded paper comprises cellulose and a polymer.

Figure 3:
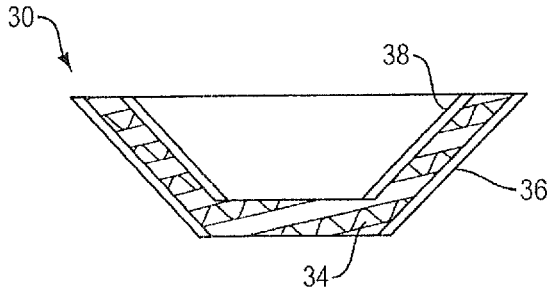
FIG. 3 is a cross-sectional view of an acoustic diaphragm.

The stiffness of diaphragm 25, FIG. 2, can be increased by covering some or all of one or both of its surfaces with a thin, stiff skin. The skin is made from a different material than layer 27. In non-limiting examples, the skin can be made from a material comprising a metal, a polymer or a thermoset, for example. Skin 29, FIG. 2, can be a thin aluminum or aluminum alloy layer that is bonded to the underside of layer 27. Skin 29 may alternatively be made from a polymer such as a polycarbonate, a polyolefin fabric, or a thermoset such as a cross-linked polyurethane, for example. Binding of the skin to layer 27 may be accomplished with adhesive substance 28. In some non-limiting examples, adhesive substance 28 is also a damping material. Damping materials are further described elsewhere herein. As illustrated by diaphragm 30, FIG. 3, expanded material layer 34 can be covered on both its top and bottom sides by skins 38 and 36, respectively. The skins may have a thickness of from about 7 microns to about 250 microns. The thickness is dependent at least in part on the skin material, the stiffness desired of the diaphragm with the skin, and other factors discussed herein. As two non-limiting examples, aluminum skins may have a thickness of from about 7 microns to about 50 microns, and polymer skins may have a thickness of from about 50 microns to about 250 microns.

In an alternative example the acoustic diaphragm may comprise a paper layer rather than an expanded material layer. Desired stiffness is achieved in this case by using one or two skins made of a different material than the underlying paper layer. The skins may for example be of one or more of the types described herein.

Figure 4:
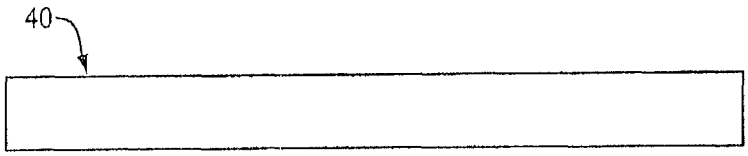
FIG. 4 is a side view of an acoustic diaphragm.
Figure 5:
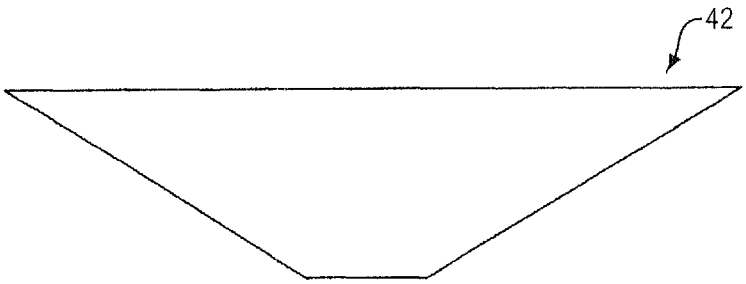
FIG. 5 is a side view of an acoustic diaphragm.

The subject acoustic diaphragm can take any desired shape. The diaphragm can, for example, be flat or generally flat, or not. It can be generally cone shaped (e.g., frustoconical), and have a desired height to diameter ratio (i.e., aspect ratio). It can be annular, oval, square or rectangular, or have other shapes or peripheral configurations. The shape will normally be dictated by the requirements of the acoustic transducer in which the diaphragm is to be used. Examples of shapes include flat diaphragm 40, FIG. 4 and frustoconical diaphragm 42, FIG. 5.

Figure 6:
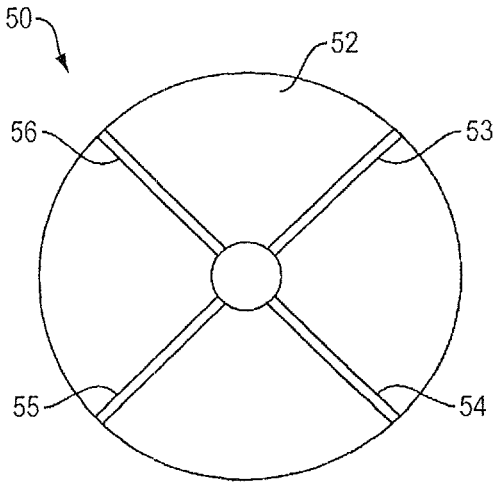
FIG. 6 is a top view of an acoustic diaphragm.

The diaphragm can include ribbing that can change the stiffness profile. The ribbing can be integrally formed in the expanded material layer, and on one or both surfaces of the diaphragm, or the ribbing can be in one or both skins when skins are present. For a diaphragm that is generally round such as diaphragm 50, FIG. 6, ribs 53-56 on surface 52 may be radial, or at least generally radial. When ribbing is radial, it may extend along some of, most of or all of the length of the radii, as in FIG. 6. However, the ribbing need not be radial; it can be designed to achieve a desired stiffness and other properties that are useful for the particular diaphragm and the acoustic transducer in which the diaphragm is to be used.

Figure 7:
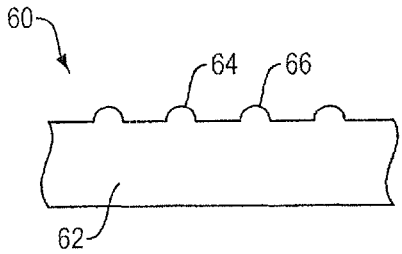
FIG. 7 is a cross-sectional view of an acoustic diaphragm.
Figure 8:
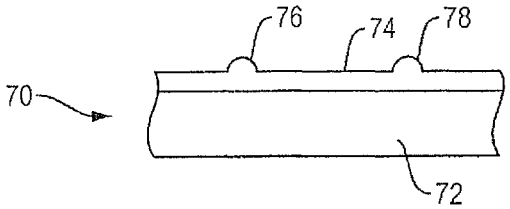
FIG. 8 is a cross-sectional view of an acoustic diaphragm.

Integral ribbing is illustrated in cellulose-containing layer 60, FIG. 7, where spaced ribs such as ribs 64 and 66 project from one surface. Ribs 64 could be created by, for example, the shape of the mold tool. An alternative illustrated in diaphragm 70, FIG. 8, includes surface ribbing 76 and 78 formed in skin 74 that overlies a surface of expanded material layer 72. Ribbing in a skin can be formed in the skin before it is applied to the expanded material layer, or the expanded material layer can be created with surface ribs, and the skin can conform to this shape when applied so as to create ribbing in the skin.

When present, the skin(s) can be coupled to a surface of the expanded material layer in a desired fashion. One preferred manner is to use a material that acts like an adhesive between the expanded material layer and the skin. Such materials may include a soft polymer resin such as polyethylene, or a thermoset such as epoxy, for example. The adhesive may also act as a damping agent that helps to damp unwanted vibrations of the diaphragm. Low-density polyethylene, various pressure-sensitive adhesives (PSAs) such as carboxylated acrylics, carboxylated ethylene/vinyl acetate (EVA) copolymer, and thermoplastic elastomers (TPEs), such as styrene-isobutylene-styrene block copolymers can be used as damping adhesives. The adhesive can be applied to the outer surface of the expanded material layer, or one surface of the skin, and then the skin can be applied to the expanded material layer. The skins can be applied via insert molding, or can be applied post-molding.

Figure 12:
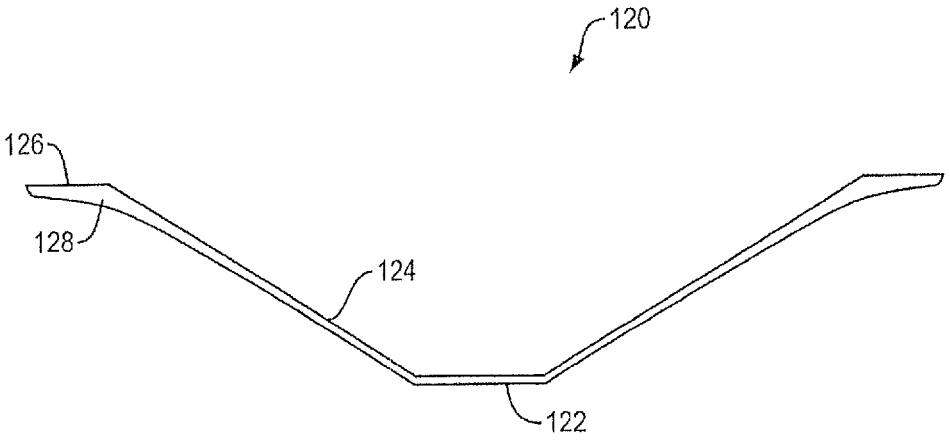
FIG. 12 is a cross-sectional view of an acoustic diaphragm with varied thickness.

Desired acoustic response of a diaphragm can at least in part also be accomplished by varying the thickness of the diaphragm across its dimensions. A non-limiting example is shown in FIG. 12, wherein diaphragm 120 comprises an expanded paper layer with central area 122, shallow walls 124 and flange 126. Location 128 where wall 124 meets flange 126 can be thickened as shown, to create additional stiffness in this location. Variable thickness can be created by appropriate shaping of the mold tool. Similar variable stiffness results can be achieved by varying the density of the expanded material layer. Density variation can be accomplished by three dimensional felting such as can be accomplished by the use of a felting tool, which can be a plate with grooves or other depressions machined into its surface that is part of the mold tool used during expansion/foaming of the material; these depressions become raised features in the finished diaphragm. Alternatively, the felting tool can be used to create a flush diaphragm surface but with varied densities of the diaphragm material (i.e., uniform thickness but variable density), which can be caused by pressing down of the raised features. Thus felting can create diaphragms with either constant areal densities or variable areal densities.

Maximizing the first modal frequency of a diaphragm of fixed dimensions and minimizing its mass may be achieved by maximizing the material merit number of $|E^*|/\rho^3$, where $E^*$ is the complex tensile modulus and $\rho$ is density. It has been found that materials characterized by $|E^*|/\rho^3$ of from about 30 to about 500 $Pa*m^9/kg^3$ provide for efficient diaphragms with better frequency response than a material with a lower $|E^*|/\rho^3$. High value of $|E^*|/\rho^3$ is equivalent to a high value of bulk longitudinal speed of sound, the square root of the ratio of $|E^*|/\rho$, and a low value of areal density in the completed diaphragm. It has been found that diaphragm materials of this disclosure (with low areal densities between about 0.4 and about 1 $kg/m^2$ and particularly those with one or two skins) should have a longitudinal speed of sound that is generally in the range of from about 1,500 meters per second (m/s) to about 7,000 m/s.

Figure 9:
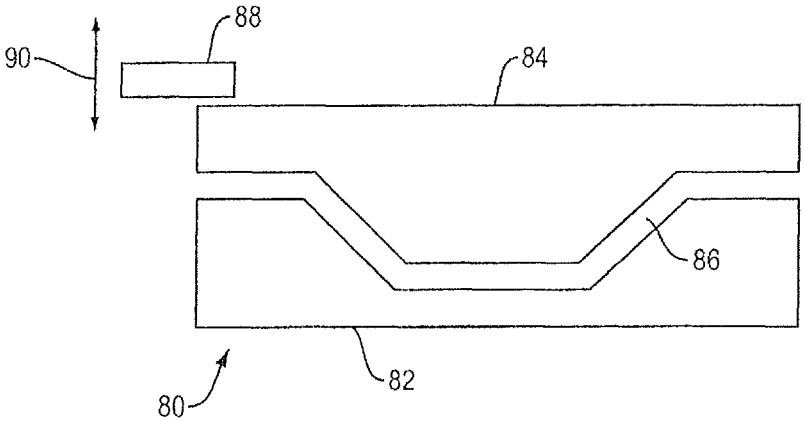
FIG. 9 is a schematic diagram of a mold for fabricating an acoustic diaphragm.

A molding process that allows for different thicknesses and densities of the cellulose-containing layer is schematically depicted in FIG. 9. Mold 80 comprises lower tool part 82 and mating upper tool part 84 that can float up and down relative to tool part 82 as depicted by arrow 90, to create cavity 86. The upper limit of travel of tool part 84 can be limited by using a stop 88. The extent of travel, along with the configuration of cavity 86, can create an expanded material layer with a particular thickness, particular variable thicknesses, and a particular density/variable density.

Table 1 presents data for some of the materials used in the present diaphragms, and for diaphragms made from prior art materials. Table 2 presents data for certain components of the acoustic diaphragms that fall under the principles of the present disclosure. Several acoustic diaphragms with expanded paper material that comprises cellulose (with and without skins), and paper diaphragms with skins, were fabricated and tested for certain properties. Some of the test data is presented in Table 3.

TABLE 1

(prior art)

| Sample ID | Composition | Thickness (mm) | Density ($g/cm^3$) | Areal density ($g/cm^2$) | $\|E^*\|$ (MPa) | $\|E^*\|/\rho^3$ ($Pa * m^9/kg^3$) | $(\|E^*\|/\rho)^{0.5}$ m/s | tanδ |
|---|---|---|---|---|---|---|---|---|
| Standard paper | Paper pulp with paper chemicals | 0.59 | 0.5737 | 0.034 | 2500 | 13 | 2088 | 0.023 |
| Paper (beaten) | Beaten pulp w/out paper chemicals | 0.63 | 0.6230 | 0.039 | 3900 | 15 | 2437 | 0.028 |
| Paper (beaten) | Beaten pulp with paper chemicals | 0.30 | 0.6341 | 0.019 | 3000 | 12 | 2175 | 0.028 |
| Lyocell | Lyocell w/out paper chemicals | 0.68 | 0.5640 | 0.038 | 1660 | 9 | 1716 | 0.024 |
| Fiber composite | PAN fiber/PP fiber/glass fiber/Pulp | 0.67 | 0.5429 | 0.036 | 2000 | 12 | 1919 | 0.030 |
| Aluminum | Aluminum alloy 1100 | 0.77 | 2.70 | 0.208 | 71000 | 3.6 | 5128 | 0.001 |
| PET | Poly(ethylene terephthalate) | N/A | 1.38 | N/A | 4500 | 1.7 | 1806 | 0.010 |
| PP | Polypropylene | N/A | 0.91 | N/A | 1300 | 1.7 | 1195 | 0.090 |

TABLE 2

(components)

| Sample ID | Composition | Thickness (mm) | Density ($g/cm^3$) | Areal density ($g/cm^2$) | $\|E^*\|$ (MPa) | $\|E^*\|/\rho^3$ ($Pa * m^9/kg^3$) | $(\|E^*\|/\rho)^{0.5}$ m/s | tanδ |
|---|---|---|---|---|---|---|---|---|
| Aluminum | Aluminum alloy 1100 | 0.77 | 2.70 | 0.208 | 71000 | 3.6 | 5128 | 0.001 |
| PC | Polycarbonate | 1.59 | 1.18 | 0.188 | 2400 | 1.5 | 1426 | 0.008 |
| SIBStar 102T | isobutylene/styrene 85/15 | 2.95 | 0.947 | 0.280 | 15 | 0.02 | 126 | 1.600 |
| Vinnapas EP7000 | ethylene/vinyl acetate with PVA | 2.15 | 1.050 | 0.226 | 827 | 0.71 | 887 | 1.550 |
| Airflex 426 | ethylene/vinyl acetate/acrylic acid | 1.45 | 1.188 | 0.173 | 500 | 0.30 | 649 | 1.400 |
| LDPE | Low density polyethylene | 0.03 | 0.920 | 0.002 | 75.4 | 0.10 | 286 | 0.230 |

TABLE 3

(examples)

| Sample ID | Composition | Thickness (mm) | Density ($g/cm^3$) | Areal density ($g/cm^2$) | $\|E^*\|$ (MPa) | $\|E^*\|/\rho^3$ ($Pa * m^9/kg^3$) | $(\|E^*\|/\rho)^{0.5}$ m/s | tanδ |
|---|---|---|---|---|---|---|---|---|
| Expanded composite 1 | 25/75 BA/Beaten pulp | 0.51 | 0.108 | 0.006 | 280 | 223 | 1611 | 0.029 |
| Expanded composite 2 | 25/75 BA/Beaten pulp | 0.97 | 0.108 | 0.010 | 248 | 197 | 1516 | 0.020 |
| Expanded composite 3 | 32/68 BA/Beaten pulp | 3.83 | 0.104 | 0.040 | 350 | 308 | 1831 | 0.040 |
| Expanded composite 4 | 44/56 BA/Beaten pulp | 5.08 | 0.030 | 0.040 | 180 | 358 | 1505 | 0.039 |
| Expanded composite 5 | 44/56 BA/Beaten pulp | 2.38 | 0.085 | 0.020 | 165 | 269 | 1393 | 0.040 |
| Expanded composite 6 | 44/56 BA/Beaten pulp | 1.61 | 0.112 | 0.018 | 370 | 262 | 1816 | 0.030 |
| Expanded composite 7 | 44/56 BA/Beaten pulp | 1.14 | 0.145 | 0.017 | 310 | 101 | 1462 | 0.030 |
| Expanded composite 8 | 44/56 BA/Beaten pulp | 0.88 | 0.129 | 0.011 | 265 | 125 | 1436 | 0.025 |
| Expanded composite 9 | 44/56 BA/Beaten pulp | 1.06 | 0.108 | 0.011 | 180 | 144 | 1292 | 0.030 |
| Expanded composite 10 | 32/43/25 BA/Beaten Pulp/glass | 3.75 | 0.101 | 0.038 | 300 | 289 | 1721 | 0.025 |
| Expanded composite 11 | 32/48/20 BA/Beaten Pulp/glass | 4.18 | 0.095 | 0040 | 240 | 277 | 1586 | 0.026 |
| Expanded composite 12 | 32/53/15 BA/Beaten Pulp/glass | 4.27 | 0.096 | 0.041 | 210 | 234 | 1476 | 0.033 |
| Expanded composite 13 | 32/68 BA/Paper pulp | 4.87 | 0.032 | 0.040 | 120 | 216 | 1208 | 0.020 |
| Expanded composite 14 | 32/68 BA/Paper pulp | 3.20 | 0.103 | 0.033 | 220 | 200 | 1460 | 0.022 |
| Expanded composite 15 | 40/40/20 BA/PAN/ Paper pulp | 2.80 | 0.136 | 0.038 | 170 | 67 | 1118 | 0.035 |
| Expanded composite 16 | 40/40/20 BA/PAN/ Paper pulp | 4.20 | 0.096 | 0.040 | 95 | 107 | 968 | 0.035 |
| Expanded composite 17 | 40/40/20 BA/PAN/ Paper pulp | 8.30 | 0.053 | 0.044 | 25 | 170 | 688 | 0.033 |
| Expanded composite 18 | 40/40/20 BA/PAN/ Paper pulp | 9.70 | 0.048 | 0.046 | 16 | 147 | 579 | 0.030 |
| Expanded composite 19 | 15/21.25/21.25/42.5 BA/PAN/ PP/Paper pulp | 2.60 | 0.152 | 0.040 | 130 | 37 | 925 | 0.040 |
| Expanded composite 20 | 25/18.75/18.75/37.5 BA/PAN/ PP/Paper pulp | 4.45 | 0.102 | 0.045 | 65 | 61 | 798 | 0.050 |
| Exp. Comp. Al skins 1 | 50 μm Al 20 μm LDPE on 35/65 BA/Beaten pulp | 1.62 | 0.317 | 0.051 | 16000 | 505 | 7110 | 0.001 |
| Exp. Comp. Al skins 2 | 50 μm Al 20 μm LDPE on 35/65 BA/Beaten pulp | 5.91 | 0.118 | 0.070 | 4854 | 2991 | 6431 | 0.004 |
| Exp. Comp. Al skins 3 | 25 μm Al 75 μm pliogrip on 44/56 BA/Beaten pulp | 2.79 | 0.381 | 0.106 | 1500 | 27 | 1984 | 0.050 |
| Exp. Comp. Al skins 4 | 75 μm Al 50 μm pliogrip on 32/68 BA/Beaten pulp | 4.32 | 0.334 | 0.144 | 2000 | 54 | 2447 | 0.030 |
| Exp. Comp. Al skins 5 | 100 μm Al 275 μm pliogrip on 32/68 BA/Beaten pulp | 4.54 | 0.343 | 0.156 | 2000 | 50 | 2415 | 0.030 |
| Exp. Comp. Al skins 6 | 100 μm Al 150 μm pliogrip on 32/68 BA/Beaten pulp | 4.64 | 0.385 | 0.178 | 3000 | 53 | 2791 | 0.017 |
| Exp. Comp. pliogrip skins | 125 μm pliogrip on 32/68 BA/Beaten pulp | 4.78 | 0.365 | 0.175 | 860 | 18 | 1535 | 0.080 |
| Exp. Comp. SIBS 102T skins | 18 μm SIBS on 40/40/20 BA/PAN/Paper pulp | 4.04 | 0.1236 | 0.050 | 120 | 64 | 985 | 0.080 |

In these tables, in the compositions the amounts are given by weight percent. Also, BA stands for a blowing agent (which in one non-limiting example is Advancell EMH 204 from Sekisui), glass is EC-11-3-SP glass fibers from JSA Valmiera Glass, PAN is fibrillated acrylic fiber as disclosed in U.S. Pat. No. 8,172,035 (the disclosure of which is incorporated herein in its entirety), Pliogrip is a polyurethane structural adhesive available from Ashland Chemical, and PP is polypropylene fibrids as disclosed in U.S. Pat. No. 8,172,035. The glass can be short cut e-glass fibers as disclosed in U.S. Pat. No. 8,172,035, Lyocell is reconstituted cellulose fiber from EFT, SIBS is SIBStar from Kaneka Corporation (styrene-isobutylene-styrene triblock copolymer thermoplastic elastomer), Al is aluminum foil, either close to 100% Al (like alloy 1100, 'commercially pure'), or an alloy with ~5% Mg (composition like alloy 5056), and the beaten pulps are beaten pulps that may be of the types as disclosed in U.S. Pat. No. 8,172,035. Further, the variable tan δ is a measure of damping, i.e., the ratio of the loss modulus (E", the imaginary part of the complex dynamic tensile modulus, E*=E'+i*E") and the storage modulus (E', the real part of the complex dynamic tensile modulus). δ=arctan E"/E' is the phase lag between stress and strain, and tan δ=E"/E'. The higher it is, the more damped the material is. The materials used in these tables are merely exemplary; other materials may be used to construct diaphragms according to the principles described herein.

On-axis sound pressure level of acoustic transducers, built with the diaphragms of the present disclosure, was measured. Sound output was measured at 1 m in front of the transducer, at 1V. Several examples are presented in the plots of FIGS. 13-21. Details of construction are given in the figure legends. Exp. comp. stands for expanded composite.

Figure 13:
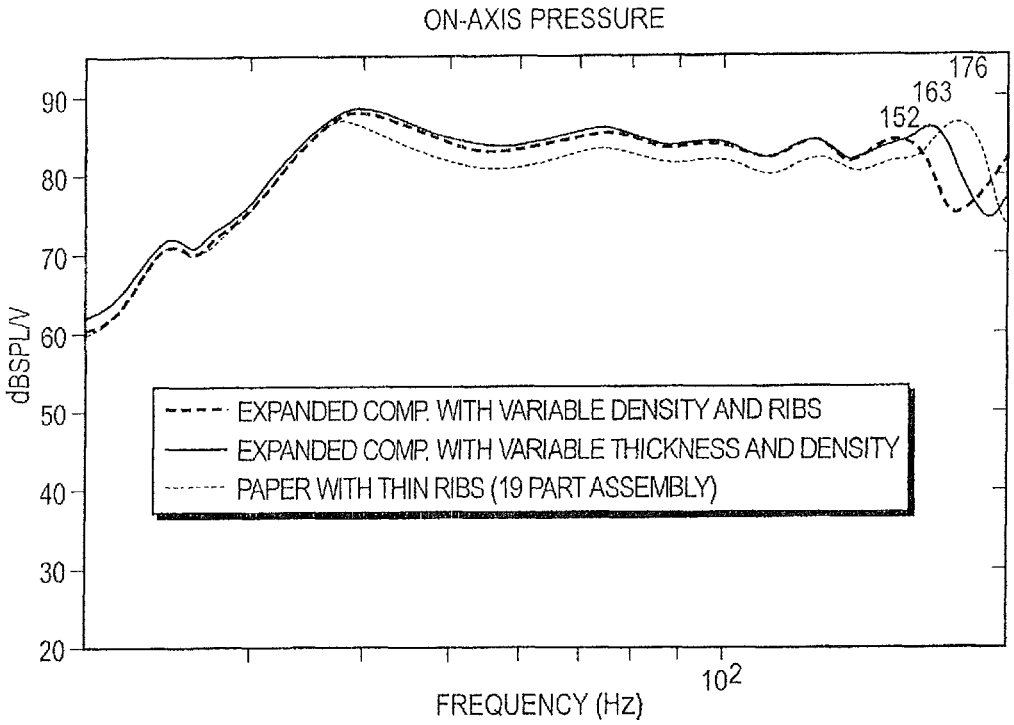
FIGS. 13-21 are plots that illustrate aspects of the subject acoustic diaphragms.
Figure 14:
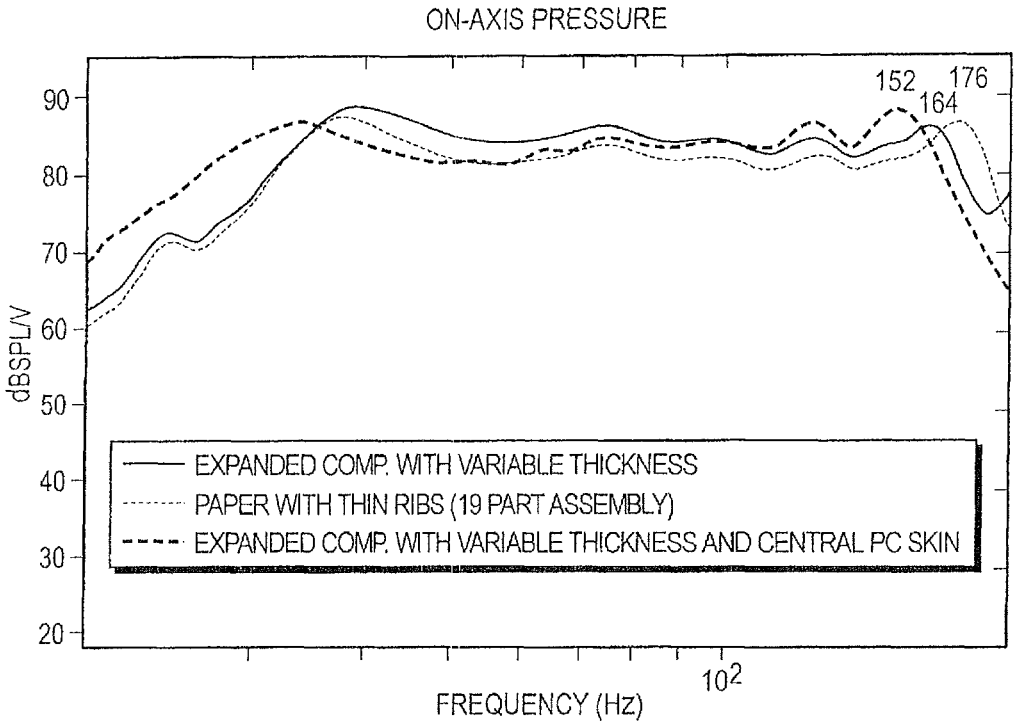

FIG. 13 shows sound pressure level per volt for expanded paper composite diaphragms for subwoofers that have similar frequency response as a thin paper diaphragm made from 19 pieces of paper that were glued together. FIG. 14 adds to FIG. 13 another version of a diaphragm with a polycarbonate skin.

Figure 15:
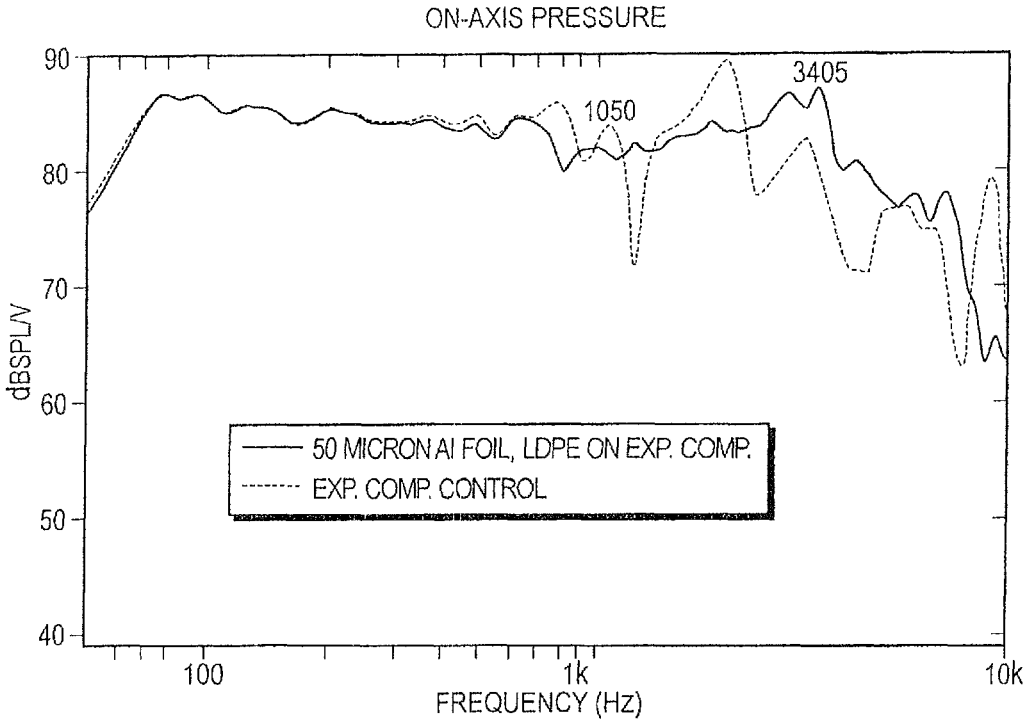
Figure 16:
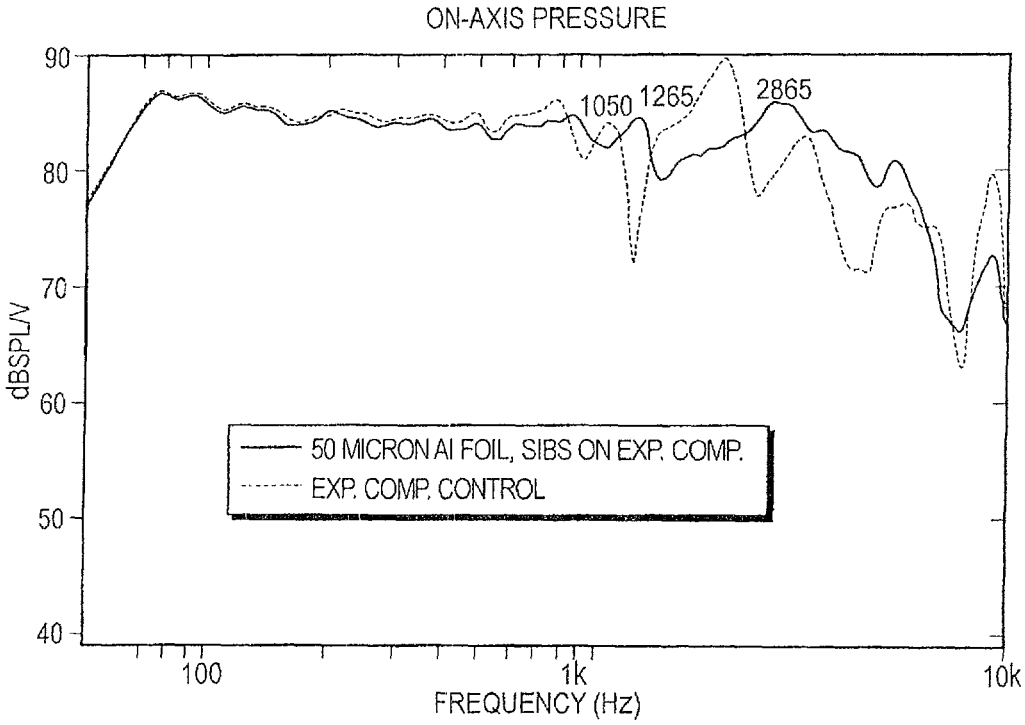
Figure 17:
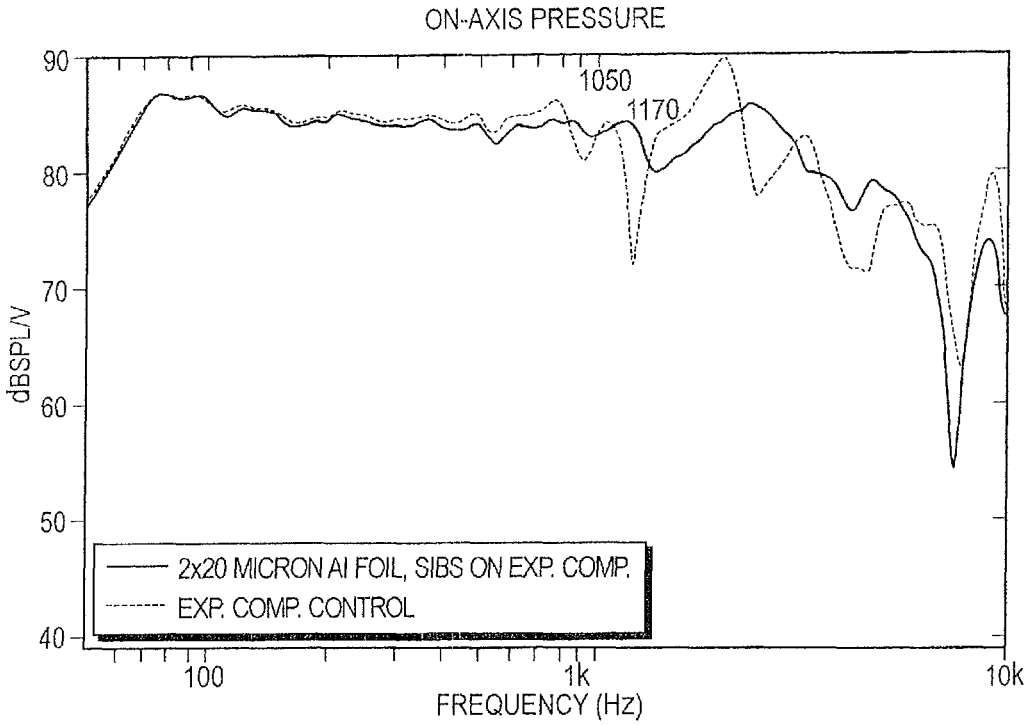
Figure 18:
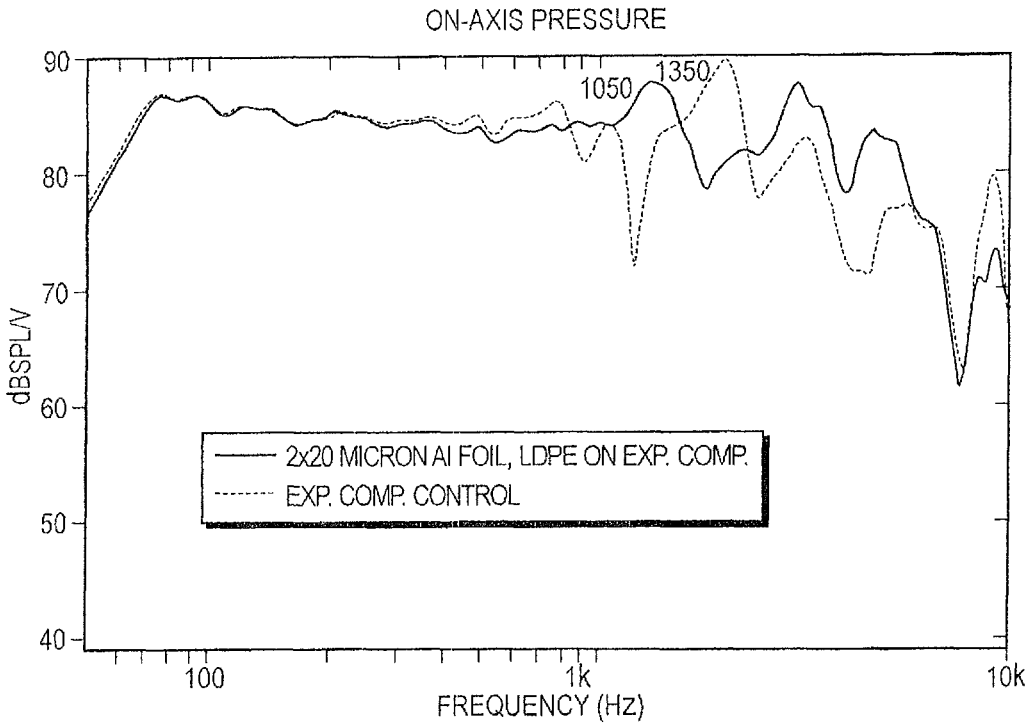
Figure 19:
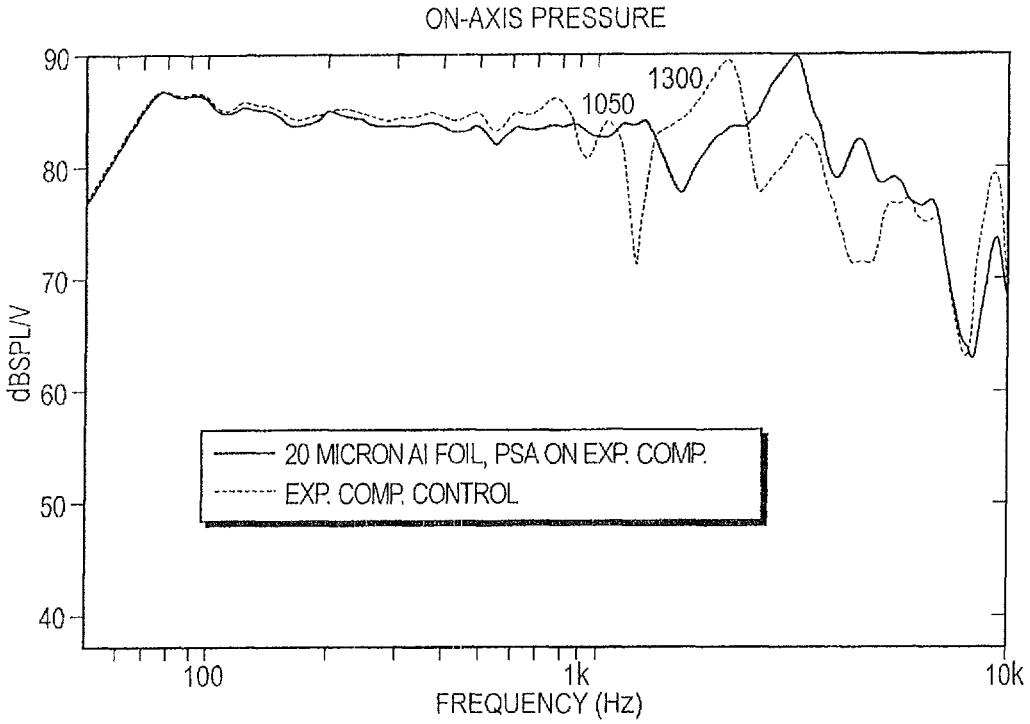
Figure 20:
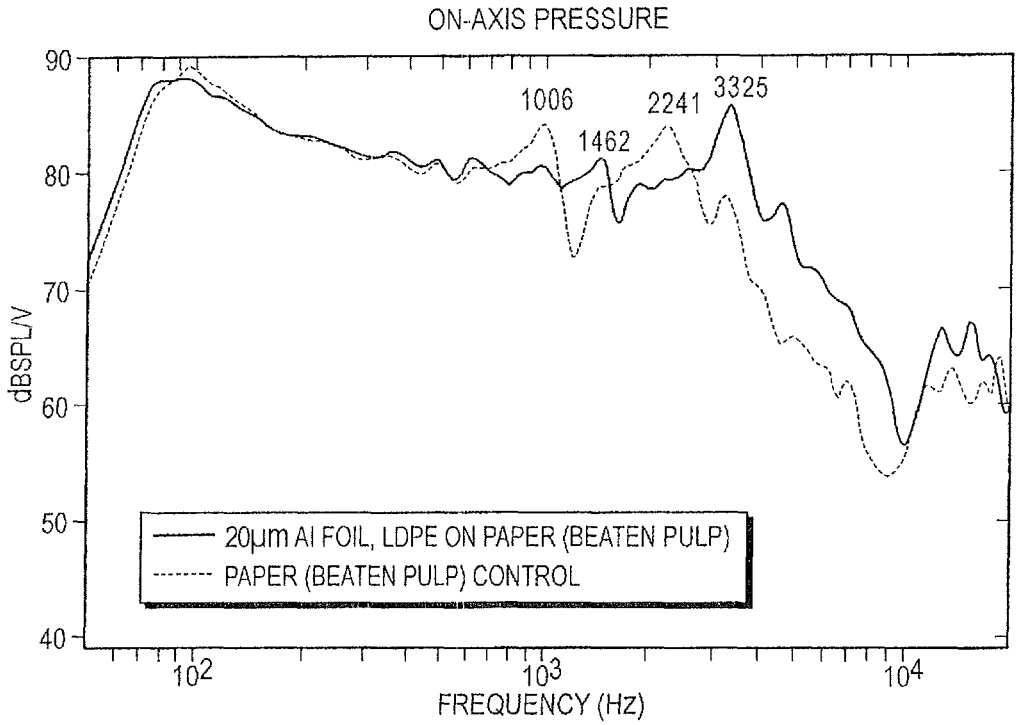

FIGS. 15-20 present measurements of a bass diaphragm with a height to diameter ratio of 0.15, a diameter of 112 mm, and bandwidth of from about 50 Hz to about 6 kHz. FIG. 15 illustrates that adding an aluminum skin adhered with low density polyethylene (LDPE) shifts the first breakup mode from about 1000 to about 3400 Hz, indicating increased stiffness. The low intensity of peaks indicates damping. FIG. 16 is for a similar laminate but with the damping component being SIBS. FIG. 17 is a similar plot but with aluminum skins on both sides of the diaphragm. FIG. 18 illustrates that when LDPE is used rather than SIBS there is less damping and the frequency response is less smooth. However the results are still much better than the control, including a shift of the first breakup mode to a higher frequency. FIG. 19 has a 20 μm aluminum foil skin on the inside and uses PSA as the adhesive/damping material. There is still a shift in the first resonance to higher frequency, and a smoother response than the control. FIG. 20 illustrates a different diaphragm core material, with an aluminum skin. In this case paper from beaten pulp (unexpanded) was used rather than the expanded paper. This illustrates a good shift of the breakup to higher frequencies, along with damping.

Figure 21:
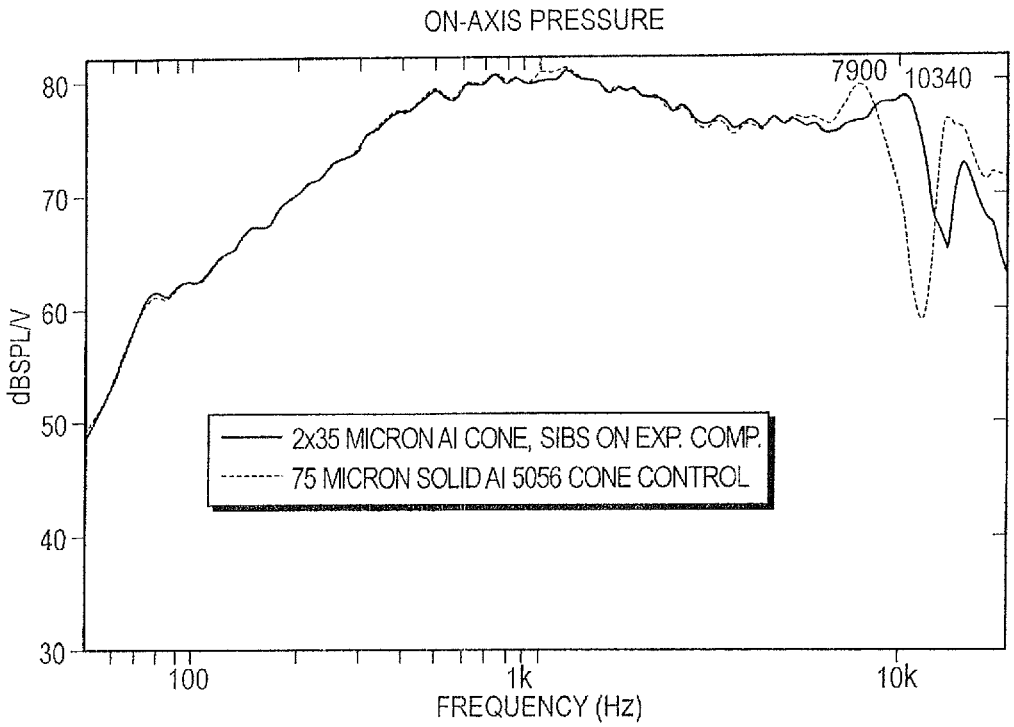

FIG. 21 includes measurements of a diaphragm for a micro speaker with a height to diameter ratio of 0.13, a diameter of 26 mm and a bandwidth from about 300 Hz to about 15 kHz. The control in this case is a solid aluminum cone. The inventive diaphragm has two layers of aluminum (one on each side) and SIBS is the adhesive/damping material. This example illustrates a shift of the breakup mode to a higher frequency and thus increased stiffness, along with damping as indicated by a smaller resonance peak and smaller dip.

The data and figures establish that the acoustic diaphragms produced according to the principles herein are stiff and damped.

Figure 10A:
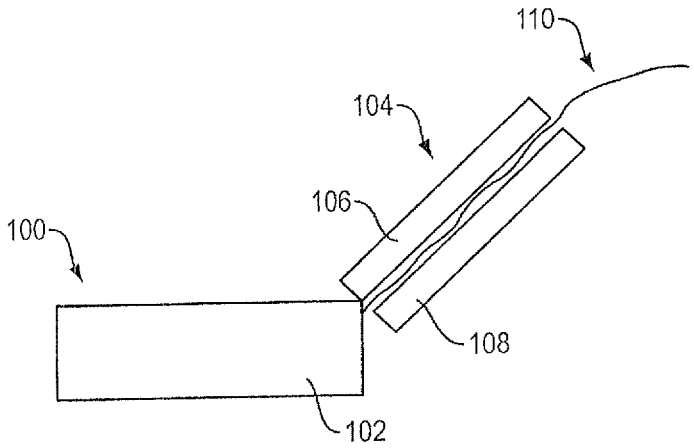
FIG. 10A is a partial, exploded view of an acoustic diaphragm assembly.

Acoustic transducers with a voice coil have an electrical lead that runs from the voice coil to the control electronics. This lead is often either a thin wire, or a flat conductor or "ribbon." Tinsel leads are bulkier and more difficult to fixture, and flying lead-outs may create a buzz. The wire or ribbon can be difficult to handle and terminate during the transducer assembly process where the lead needs to be terminated at the voice coil and to a remote structure. The leads may be embedded in or disposed within the expanded composite diaphragm itself, that may (or may not) comprise stiff surface skins. In the present acoustic transducer assembly 100, FIG. 10A, wire or ribbon 110 leads from (i.e., is electrically coupled to) voice coil 102 of acoustic transducer 100. Only part of diaphragm 104 is depicted, and it is exploded to clarify its construction. Wire or ribbon 110 may be located between paper/expanded paper layer 106 and an underlying or overlying skin 108. Wire or ribbon 110 may or may not be insulated, as necessary dependent in part on the skin material. When the skin is a metal such as an aluminum foil, the wire or ribbon may need to be insulated so that it does not short to the skin. The free end of wire or ribbon 100 (located outside of diaphragm 104) provides sufficient free length to simplify its electrical termination during the assembly process. Transducers with thin wire leads may be fabricated in a similar fashion, running the thin wire electrical lead between the layers of a laminated diaphragm. Alternatively, the wire or ribbon may be embedded into the cellulose-containing layer, for example during the felting/molding process.

Figure 10B:
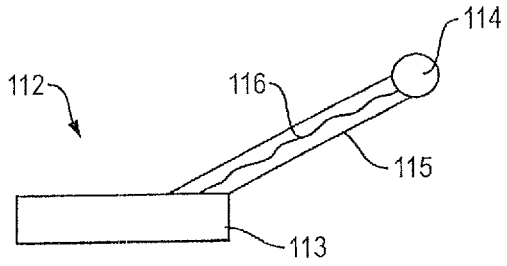
FIG. 10B illustrates an acoustic diaphragm assembly with an electrical lead embedded in a diaphragm and terminated at the voice coil and the surround.

Acoustic transducer assembly 112, FIG. 10B, illustrates an electrical lead 116 embedded in a diaphragm 115 and terminated (coupled to) the voice coil 113 and the surround 114. Coupling can be accomplished with an adhesive or by other means. If lead 116 is taut between its two attachment points, during times of high excursion there can be too much stress on the wire, which can lead to breakage. One technique to increase the length and thus allow for this excursion is to crimp the lead, as is known in the art.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic diaphragm assembly, comprising:

a diaphragm comprising a cellulose-containing material, and having opposed surfaces, wherein the diaphragm comprises a plurality of layers, the layers comprising a cellulose-containing layer that comprises expanded cellulose-containing paper material that has more than about 55% by volume voids, and a skin at least partially overlying and fixed by an adhesive material to the cellulose-containing layer, wherein the skin is made from a different material than the cellulose-containing layer; and a voice coil electrical lead, wherein at least part of the electrical lead is embedded in the diaphragm, between the opposed surfaces of the diaphragm, and wherein a portion of the electrical lead is located between the cellulose-containing layer and the skin.

2. The acoustic diaphragm assembly of claim 1 wherein the skin comprises at least one of: a metal layer, a plastic layer, and a thermoset layer.

3. The acoustic diaphragm assembly of claim 1 wherein the adhesive material comprises a damping material.

4. The acoustic diaphragm assembly of claim 1 wherein the skin has a thickness of from about 7 microns to about 250 microns.

5. The acoustic diaphragm assembly of claim 1 wherein the cellulose-containing layer has a density between about 0.04 g/cc and about 0.7 g/cc.

6. The acoustic diaphragm assembly of claim 1 wherein the electrical lead is coated at least in part with the adhesive material.

7. The acoustic diaphragm assembly of claim 1 wherein a portion of the electrical lead is not embedded in the diaphragm, and that portion is crimped.

8. The acoustic diaphragm assembly of claim 1 wherein the diaphragm comprises at least one of: an expanded cellulose-containing paper material and an expanded synthetic paper material.

9. An acoustic diaphragm assembly, comprising:

a diaphragm comprising an expanded material that comprises at least one of: an expanded cellulose-containing paper material and an expanded synthetic paper material, wherein the expanded material has more than about 70% by volume voids and a density between about 0.04 g/cc and about 0.7 g/cc, and one or more skins at least partially overlying and fixed to the expanded material by an adhesive material, wherein a skin is made from a different material than the expanded material; and a voice coil electrical lead that is at least partially disposed within the diaphragm between the expanded material and the skin.

10. The acoustic diaphragm assembly of claim 9, wherein the skin comprises at least one of: a metal layer, a plastic layer, and a thermoset layer.

11. The acoustic diaphragm assembly of claim 9, wherein the skin has a thickness of from about 7 microns to about 250 microns.

12. The acoustic diaphragm assembly of claim 9 wherein the expanded material comprises synthetic fibers and glass fibers.

13. An acoustic diaphragm assembly, comprising:

a diaphragm having opposed surfaces and comprising an expanded paper material, wherein the expanded paper material comprises at least one of expanded cellulose-containing paper material and expanded synthetic paper material and has more than about 70% by volume voids, and a density between about 0.04 g/cc and about 0.7 g/cc; and a voice coil electrical lead, wherein at least part of the electrical lead is disposed within the expanded paper material, between the opposed surfaces of the diaphragm.

14. The acoustic diaphragm assembly of claim 13, wherein the diaphragm comprises a plurality of layers, and at least two of the layers are coupled together with a damping material.

15. The acoustic diaphragm assembly of claim 14, wherein the layers comprise a cellulose-containing layer and a skin at least partially overlying and fixed by an adhesive to the cellulose-containing layer, wherein the skin is made from a different material than the cellulose-containing layer, and wherein a portion of the electrical lead is located between the cellulose-containing layer and the skin.

16. The acoustic diaphragm assembly of claim 14, wherein a portion of the electrical lead is located between the two layers that are coupled together.

17. The acoustic diaphragm assembly of claim 13 wherein the expanded paper material comprises synthetic fibers and glass fibers.

* * * * *